US010569551B2

(12) United States Patent
Iida

(10) Patent No.: US 10,569,551 B2
(45) Date of Patent: Feb. 25, 2020

(54) LIQUID JETTING APPARATUS INCLUDING PURGE MECHANISM

(71) Applicant: Brother Kogyo Kabushiki Kaisha, Nagoya-shi, Aichi-ken (JP)

(72) Inventor: Shotaro Iida, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/100,475

(22) Filed: Aug. 10, 2018

(65) Prior Publication Data

US 2019/0100012 A1 Apr. 4, 2019

(30) Foreign Application Priority Data

Sep. 29, 2017 (JP) ..... 2017-189856

(51) Int. Cl.
*B41J 2/165* (2006.01)

(52) U.S. Cl.
CPC ..... *B41J 2/16505* (2013.01)

(58) Field of Classification Search
CPC ..... B41J 2/16505; B41J 2/16508; B41J 2/16517; B41J 2/16526; B41J 2002/16573
See application file for complete search history.

(56) References Cited

U.S. PATENT DOCUMENTS 6,299,277 B1 * 10/2001 Fujii ..... B41J 2/1652 347/23
2016/0288506 A1 * 10/2016 Tamaki ..... B41J 2/16508

FOREIGN PATENT DOCUMENTS

JP H10-146993 A 6/1998
JP 2006-159717 A 6/2006
JP 2016-175361 A 10/2016

* cited by examiner

*Primary Examiner* — Bradley W Thies
(74) *Attorney, Agent, or Firm* — Banner & Witcoff, Ltd.

(57) ABSTRACT

There is provided a liquid jetting apparatus including: a liquid jetting head; a cap; a switching mechanism configured to perform switching of a state of the cap between a capping state and an uncapping state; a timer; a purge mechanism; and a controller. The controller performs: calculating a value of a capping-time parameter; and measuring a capping time with the timer. In a case that a purge condition regarding the capping time and the value of the capping-time parameter is satisfied, the controller causes the purge mechanism to perform a purge, and then causes the liquid jetting head to perform a jetting operation.

14 Claims, 9 Drawing Sheets

Fig. 5A

| U | D1 |
|---|---|
| $U \geqq U1$ | D11 |
| $U < U1$ | D12 |

Fig. 5B

| Tc \ Dc | $Dc \leqq Dc0$ | $Dc0 < Dc \leqq Dc1$ | $Dc > Dc1$ |
|---|---|---|---|
| $Tc \leqq Tc0$ | F1 | F2 | F2 |
| $Tc0 < Tc \leqq Tc1$ | F3 | F4 | F5 |
| $Tc > Tc1$ | F3 | F6 | F1 |

Fig. 7

| Ttc \ Dc | $Dc \leqq Dc0$ | $Dc0 < Dc \leqq Dc1$ | $Dc > Dc1$ |
|---|---|---|---|
| $Ttc \leqq Tc0$ | H1 | H2 | H2 |
| $Tc0 < Ttc \leqq Tc1$ | H3 | H4 | H5 |
| $Ttc > Tc1$ | H3 | H5 | H6 |

Fig. 8

| Tc \ Dc | $Dc \leqq Dc0$ | $Dc0 < Dc \leqq Dc1$ | $Dc > Dc1$ |
|---|---|---|---|
| $Tc \leqq Tc0$ | F1 | F2 | F2 |
| $Tc0 < Tc \leqq Tc1$ | F3 | F4 | F5 |
| $Tc > Tc1$ | F3 | F6 | F7 |

LIQUID JETTING APPARATUS INCLUDING PURGE MECHANISM

CROSS REFERENCE TO RELATED APPLICATION

The present application claims priority from Japanese Patent Application No. 2017-189856 filed on Sep. 29, 2017, the disclosures of which are incorporated herein by reference in its entirety.

BACKGROUND

Field of the Invention

The present disclosure relates to a liquid jetting apparatus which jets liquid from a nozzle.

Description of the Related Art

As an example of a liquid jetting apparatus which jets liquid from a nozzle, there is a publicly known printer which jets an ink from a nozzle so as to perform printing. In this publicly known printer, a purge is performed for causing the ink to be discharged (jetted) from the nozzle into a cap. Further, in the publicly known printer, the nozzle is covered by the cap in a stand-by state in which no printing is performed, thereby suppressing the increase in viscosity of the ink inside the nozzle.

SUMMARY

Here, even in a case that empty suction for discharging the ink from the cap is performed after the purge in the above-described printer, the ink remains to some extent in the inside of the cap. In the ink remaining in the cap, the water content is evaporated, for example, at a time of the printing during which the cap does not cover the nozzle, which in turn reduces the water content in the remaining ink (increases the evaporation rate of the water content). Normally, an ink contains a humectant for suppressing the evaporation of the water content. Accordingly, in a case that the nozzle is covered by the cap in a state that the evaporation rate of the water content is high in the ink inside the cap, the humectant in the ink inside the cap absorbs the water content of the ink inside the nozzle. This lowers, as a result, the effect of suppressing the increase in viscosity of the ink inside the nozzle which is obtained by covering the nozzle with the cap.

Further, in the above-described printer, pre-print flushing for causing the ink, of which viscosity is increased, to be jetted from the nozzle is performed immediately before performing printing. In a case that the viscosity of the ink inside the nozzle becomes high to such an extent that this highly viscous ink cannot be jetted or discharged by the flushing, it is necessary that the purge is performed immediately before performing the printing to thereby discharge the highly viscous ink inside the nozzle. However, in a case of judging (determining) the degree or extent as to how high the viscosity of the ink is, the evaporation rate of the water content in the ink inside the cap (degree or extent by which the water content in the ink inside the nozzle is absorbed by the humectant) is not considered in some cases. In such cases, the degree by which the viscosity of the ink inside the nozzle is increased is consequently determined while assuming that the evaporation rate to be high. In such a case, if the evaporation rate is low, the viscosity of the ink inside the nozzle is determined to be higher than the actual viscosity. As a result, there is such a fear that the purge might be performed unnecessarily and the ink might be discharged in vain or wastefully.

Considering the above-described situation, an object of the preset teaching is to provide a liquid jetting apparatus which is capable of suppressing, as much as possible, a discharge amount of liquid, which is to be discharged before performing a jetting, for a purpose of realizing a stable jetting of the liquid from the nozzle onto a jetting medium as an object for the jetting.

According to an aspect of the present teaching, there is provided a liquid jetting apparatus including: a liquid jetting head having a nozzle; a cap; a switching mechanism configured to perform switching of a state of the cap between a capping state in which the cap covers the nozzle and an uncapping state in which the cover is apart from the liquid jetting head; a timer; a purge mechanism; and a controller. The controller is configured to perform: controlling the liquid jetting head to perform a jetting operation for jetting liquid from the nozzle toward a medium; after controlling the liquid jetting head to perform the jetting operation, controlling the switching mechanism to perform switching of the state of the cap to the capping state; calculating a value of a capping-time parameter relating to an evaporation rate of a water content in the liquid inside the cap at a time of the switching of the state of the cap to the capping state performed last time; under a condition that a jetting instruction for instructing performance of the jetting operation is input, measuring a capping time with the timer. The capping time is one of: a time included in a time since the switching of the state of the cap to the capping state after the jetting operation performed last time and until the input of the jetting instruction, and during which the cap is in the capping state; and a time included in a time since the switching of the state of the cap to the capping state after the jetting operation performed last time and until switching of the state of the cap to the uncapping state by the input of the jetting instruction and during which the cap is in the capping state. The controller is configured to perform, under a condition that a purge condition with respect to the capping time and the value of the capping-time parameter is satisfied, controlling the purge mechanism to perform a purge for discharging the liquid in the liquid jetting head from the nozzle to the cap, and then controlling the liquid jetting head to perform the jetting operation.

In view of this situation, in the present teaching, under a condition that the purge condition with respect to the capping time and the value of the capping-time parameter is satisfied in a case that the jetting instruction is input, the jetting operation is performed after the purge has been performed. With this, in a case that the viscosity of the liquid inside the nozzle is high, the jetting operation can be performed after discharging the highly viscous liquid inside the nozzle by the purge performed prior to the jetting operation. On the other hand, in a case that the viscosity of the liquid inside the nozzle is not increased much, it is possible to prevent the liquid from being discharged unnecessarily from the liquid jetting head, by performing the jetting operation without performing the purge.

BRIEF DESCRIPTION OF THE DRAWINGS

FIG. 5A is a view depicting a table in which the temperature and a threshold value D1 are associated with each other, and FIG. 5B is a view depicting a table in which a capping time and a value of a capping-time parameter are associated with a jetting amount in a pre-print flushing.

FIG. 7 is a view depicting a table in which the capping time and the value of the capping-time parameter are associated with a discharge amount in a suction purge which is to be performed by an instruction from the user.

FIG. 8 is a view depicting another example of the table in which the capping time and the value of the capping-time parameter are associated with the jetting amount in the pre-print flushing.

DESCRIPTION OF THE EMBODIMENTS

In the following, an embodiment of the present teaching will be explained, with reference to the drawings as appropriate.

<Overall Configuration of Printer>

Figure 1:
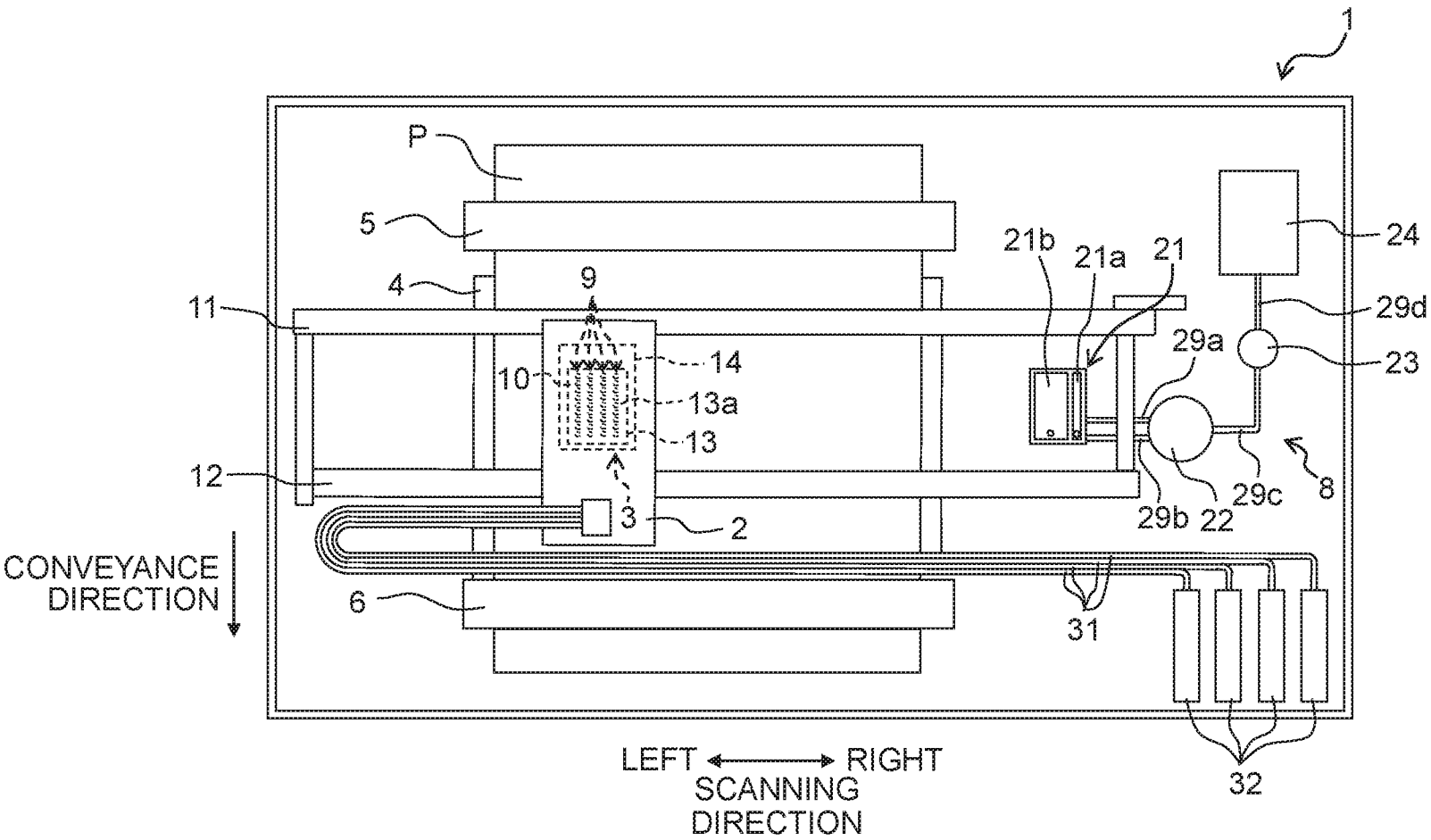
FIG. 1 is a view depicting the schematic configuration of a printer according to an embodiment of the present teaching.

As depicted in FIG. 1, a printer 1 according to an embodiment of the present teaching (corresponding to a "liquid jetting apparatus" of the present teaching) is provided with a carriage 2, an ink-jet head 3 (corresponding to a "liquid jetting head" of the present teaching), a platen 4, conveyance rollers 5 and 6, a flushing foam 7, a maintenance unit 8, etc.

The carriage 2 is supported by two guide rails 11 and 12 extending in a scanning direction. Further, the carriage 2 is connected to a carriage motor 56 (see FIG. 2) via a non-illustrated belt, etc.; in a case that the carriage motor 56 is driven, the carriage 2 is thereby reciprocated in the scanning direction along the guide rails 11 and 12. Note that in the following explanation, the right and left sides in the scanning direction are defined as the right and left sides depicted in FIG. 1.

The ink-jet head 3 is mounted on the carriage 2. The ink-jet head 3 has a channel unit 13 and an actuator 14. The lower surface of the channel unit 13 is a nozzle surface 13*a* formed with an ink channel including a plurality of nozzles 10 via which an ink is jetted or discharged. The plurality of nozzles 10 are arranged in a row in a conveyance direction orthogonal to the scanning direction to thereby form a nozzle row 9; four nozzle rows 9 are arranged side by side in the scanning direction in the nozzle surface 13*a*. Ink of which colors are black, yellow, cyan and magenta are jetted (discharged) from the four nozzle rows 9 in this order respectively from a rightmost side nozzle row 9 which is included in the four nozzle rows 9 and which is located at the right side in the scanning direction. The actuator 14 is configured to impart a jetting energy individually to the ink inside each of the nozzles 10. For example, the actuator 14 is configured to change the volume of a pressure chamber (not depicted in the drawings) which communicates with each of the nozzles 10 to thereby impart the pressure to the ink, or is configured to perform heating to thereby generate an air bubble in the pressure chamber and impart the pressure to the ink. However, since the construction of the actuator 14 itself is well known, any further detailed explanation for the actuator 14 will be omitted here.

Further, the ink-jet head 3 is connected to four ink tubes 31 via a non-illustrated sub tank, etc. The four ink tubes 31 are connected to four ink cartridges 32, respectively, which are arranged side by side in the scanning direction at a right end part of the printer 1. The black, yellow, cyan and magenta inks are stored, respectively, in the four ink cartridges 32 in this order from a rightmost side ink cartridge 32 which is included in the four ink cartridges 32 and which is located at the right side in the scanning direction; the four color inks that are the black, yellow, cyan and magenta inks stored in the four ink cartridges 32, respectively, are supplied to the ink-jet head 3 via the four ink tubes 31, etc.

The platen 4 is located at a position below the ink-jet head 3, and faces (is opposite to) the nozzle surface 13*a* during the printing. The platen 4 extends in the scanning direction, over the entire length of a recording paper P (recording paper sheet P, or recording sheet P), and supports the recording paper P from therebelow. The conveyance rollers 5 and 6 are located respectively on the upstream side and the downstream side in the conveyance direction of the platen 4. The conveyance rollers 5 and 6 are connected to a conveyance motor 57 (see FIG. 2) via a non-illustrated gear, etc. In a case that the conveyance motor 57 is driven, the conveyance rollers 5 and 6 are thereby rotated to convey the recording paper P in the conveyance direction.

The flushing foam 7 is, for example, a sponge which is capable of absorbing the ink, and is located on the left side in the scanning direction with respect to the platen 4. Corresponding to this, in the printer 1, a controller 50 (to be described later on) performs control such that the carriage 2 can be moved to a flushing position at which the nozzle surface 13*a* faces (is opposite to) the flushing foam 7. With this, it is possible to perform, in the printer 1, a pre-print flushing (to be described later on) in which the ink-jet head 3 is caused to jet the ink from the plurality of nozzles 10 in a state that the carriage 2 is located at the flushing position, thereby discharging any highly viscous ink inside the nozzles 10.

<Maintenance Unit>

The maintenance unit 8 includes a cap 21, a switching unit 22, a suction pump 23 and a waste liquid tank 24.

The cap 21 is located on the right side in the scanning direction with respect to the platen 4. Corresponding to this, it is possible, in the printer 1, to move the carriage 2 up to a maintenance position at which the nozzle surface 13*a* faces (is opposite to) the cap 21. The cap 21 has a cap section 21*a* and a cap section 21*b* located on the left side of the cap section 21*a*. In a state that the carriage 2 is located at the maintenance position, nozzles 10 included in the plurality of nozzles 10 and constructing the nozzle row 9 on the rightmost side face the cap section 21*a*, and nozzles 10 included in the plurality of nozzles 10 and constructing three nozzle rows 9 on the left side face the cap section 21*b*.

Further, the cap 21 is capable of being raised and lowered (ascended/descended, moving in the up/down direction) by a cap ascending/descending mechanism 58 (see FIG. 2; corresponding to a "switching mechanism" of the present teaching); in a case that the cap 21 is raised in a state that the carriage 2 is located at the maintenance position, the cap 21 makes tight contact with the nozzle surface 13*a* so as to cover the plurality of nozzles 10 with the cap 21. More specifically, the nozzles 10 forming the nozzle row 9 on the rightmost side are covered by the cap section 21*a*, and the nozzles 10 forming the three nozzle rows 9 on the left side are covered by the cap section 21*b* (in the following, a state of the cap 21 in this situation is referred also to as a "capping state" in some cases). On the other hand, in a state that the cap 21 is lowered by the cap ascending/descending mechanism 58, the cap 21 is separate and away from the ink-jet head 3 (in the following, a state of the cap 21 in this situation is referred also to as a "uncapping state", in some cases). Namely, the cap ascending/descending mechanism 58 raises and lowers the cap 21 to thereby switch (perform switching of) the state of the cap 21 between the capping state and the uncapping state.

Further, the cap 21 is not limited to being configured to make tight contact with the nozzle surface 13*a* to cover the plurality of nozzles 10. For example, in a case that the channel unit 13 has a frame arranged so as to surround the nozzle surface 13*a* for the purpose of protecting the nozzles 10, the cap 21 may be configured to make tight contact with this frame to thereby cover the nozzles 10.

The switching unit 22 is connected to the cap sections 21*a* and 21*b* via tubes 29*a* and 29*b*, respectively. Further, the switching unit 22 is connected to the suction pump 23 via a tube 29*c*. The switching unit 22 performs switching between the connection of the suction pump 23 with the cap section 21*a* and the connection of the suction pump 23 with the cap section 21*b*. The suction pump 23 is, for example, a tube pump, etc. Further, the suction pump 23 is connected to the waste liquid tank 24.

Further, in the printer 1, in a state that the cap 21 is in the capping state, the controller 50 performs a control such that the switching unit 22 is caused to connect the cap section 21*a* to the suction pump 23. In this state, the controller 50 drives the suction pump 23, thereby making it possible to perform a suction purge regarding the black ink for discharging the black ink in the channel unit 13 from the nozzles 10 forming the nozzle row 9 on the rightmost side. Similarly, in the printer 1, in the state that the cap 21 is in the capping state, the controller 50 performs a control such that the switching unit 22 is caused to connect the cap section 21*b* to the suction pump 23. In this state, the controller 50 drives the suction pump 23, thereby making it possible to perform a suction purge regarding the color inks (yellow, cyan and magenta inks) for discharging the color inks (yellow, cyan and magenta inks) in the channel unit 13 from the nozzles 10 forming the three nozzle rows 9 on the left side. Furthermore, after performing the suction purge regarding the black ink and the suction purge regarding the color inks, the cap 21 is lowered to thereby separate the cap 21 away from the nozzle surface 13*a* and to make the cap 21 to be in the uncapping state and then the suction pump 23 is driven, thereby making it possible to execute an empty suction for discharging any ink remaining in the cap 21 due to the suction purge, from the cap 21. Moreover, the ink discharged by the suction purge and the empty suction is stored in the waste liquid tank 24.

Further, in the printer 1, it is possible to perform a moisture-retention flushing (to be described later on) for causing the ink-jet head 3 to jet the ink from the plurality of nozzles 10 in a state that the carriage 2 is located at the maintenance position, thereby discharging the ink from the nozzles 10 to the cap 21.

<Electrical Configuration of Printer>

Figure 2:
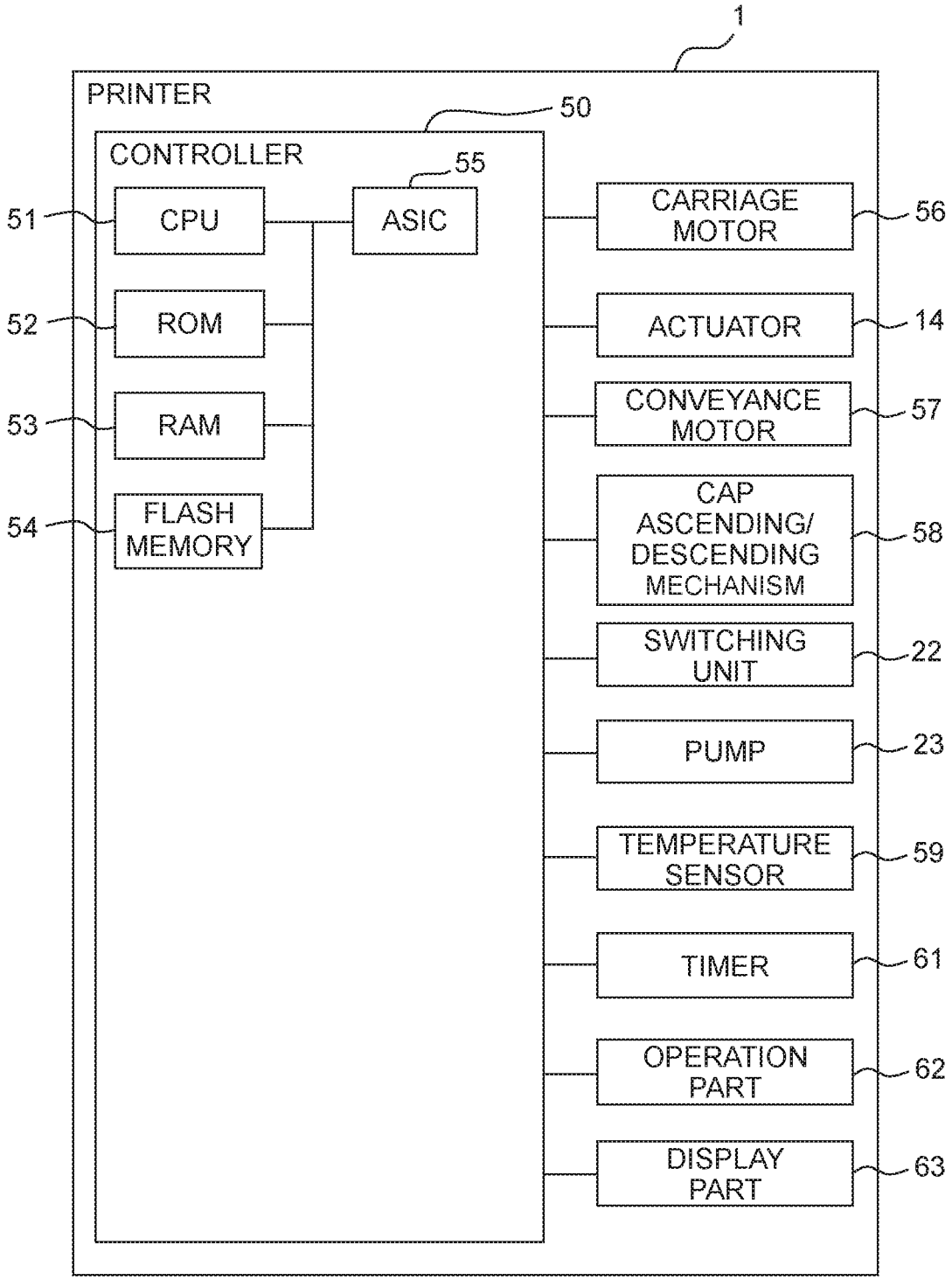
FIG. 2 is a block diagram depicting the electrical configuration of the printer according to the embodiment of the present teaching.

Next, an explanation will be given about the electrical configuration of the printer 1. The operation of the printer 1 is controlled by the controller 50. As depicted in FIG. 2, the controller 50 includes a CPU (Central Processing Unit) 51, a ROM (Read Only Memory) 52, a RAM (Random Access Memory) 53, a flash memory 54, an ASIC (Application Specific Integrated Circuit) 55, etc., and these components or elements control the carriage motor 56, the actuator 14, the conveyance motor 57, the cap ascending/descending mechanism 58, the switching unit 22, the suction pump 23, etc.

The printer 1 further has a temperature sensor 59 configured to obtain temperature information regarding the temperature around the printer 1, and the temperature information obtained by the temperature sensor 59 is input to the controller 50. Further, the printer 1 has a timer 61. The timer 61 is activated when the receptacle of the printer 1 is connected to the power source for the first time, and the timer 61 performs measurement of a duration time Ttc of the capping state of the cap 21 and measurement of a duration time Ttu of the uncapping state of the cap 21, as will be described later on. Furthermore, the printer 1 has an operation part 62 (corresponding to an "input unit" of the present teaching). The operation part 62 is constructed of a button via which a user performs operation, and the like. With this, the user is capable of perform an instruction for instructing performance of an operation, a setting, etc. with respect to the printer 1, by operating the operating part 62. Moreover, the printer 1 has a display part 63. The display part 63 is, for example, a liquid crystal display, etc., and is configured, for example, to display a matter or item necessary for the operation of the printer 1, such as a message for instructing an operation via the operating part 62, etc.

Note that although FIG. 2 depicts only one piece of the CPU 51, it is allowable that the controller 50 is provided with only one piece of the CPU 51 and that the only one CPU 51 singly performs the processings. Alternatively, it is allowable that the controller 50 is provided with a plurality of pieces of the CPU 51 and that these CPUs 51 perform the processings in a sharing manner. Further, note that although FIG. 2 depicts only one piece of the ASIC 55, it is allowable that the controller 50 is provided with only one piece of the ASIC 55 and the only one ASIC 55 singly performs the processings. Alternatively, it is allowable that the controller 50 is provided with a plurality of pieces of the ASICS 55 and that these ASICs 55 execute the processings in a shared manner.

<Calculation of Count Value>

Here, in the printer 1, the empty suction is performed, after the suction purge has been performed, to thereby discharge the ink inside the cap 21, as described above. However, even after the empty suction is performed, the ink remains inside the cap 21 more or less. Then, in a case that the cap 21 is in the uncapping state, the water content in the ink inside the cap 21 evaporates, thereby increasing the evaporation rate of the water content in the ink inside the cap 21 (hereinafter referred also to as a "cap evaporation rate" in some cases). On the other hand, normally, an ink contains a humectant for suppressing the evaporation of the water content. Accordingly, in a case that the cap 21 is in the capping state, the humectant in the ink inside the cap 21 absorbs the water content, thereby causing the water content to move from the ink inside the nozzles 10 to the ink inside the cap 21, which in turn lowers the cap evaporation rate. When the receptacle of the printer 1 is connected to the power source for the first time, the controller 50 starts a processing along the flow depicted in FIG. 3, thereby performing calculation of a count value C corresponding to the cap evaporation rate.

Figure 3:
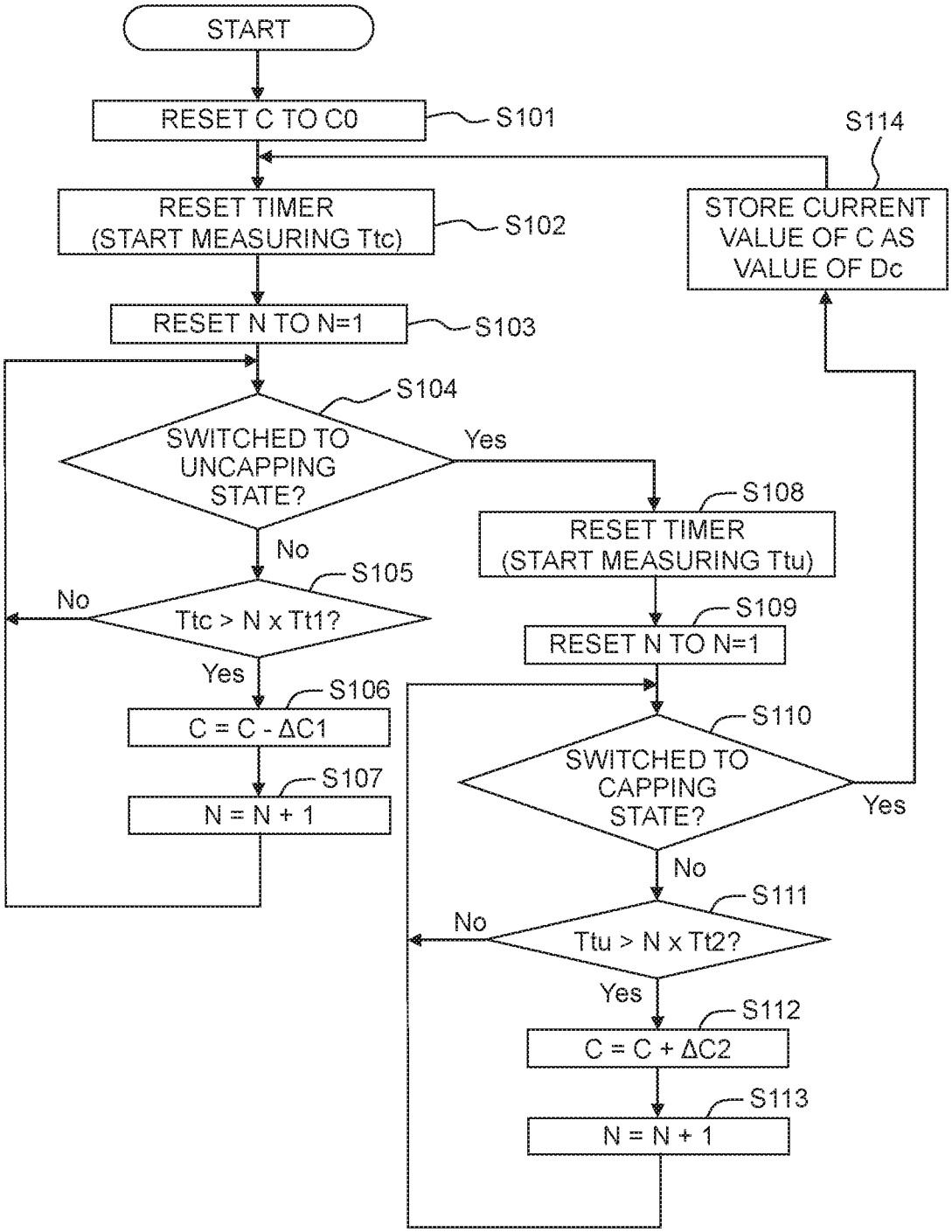
FIG. 3 is a flowchart depicting the flow of a processing for calculating a count value.

A detailed explanation will be given about the calculation of the count value C. In the printer 1 before being used, the cap 21 is in the capping state. Then, when the receptacle of the printer 1 is connected to the power source for the first time, the controller 50 resets the count value C to an initial value C0 and causes the RAM 53 to store the count value C set to the initial value C0 (S101), as depicted in FIG. 3. The initial value C0 is, for example, previously stored in the flash memory 54. Note that although any detailed explanation will be omitted here, in a case that the receptacle of the printer 1 is connected to the power source for the first time, the suction purge is performed, and then the empty suction is performed. The initial value C0 is set to a value corresponding to the cap evaporation rate immediately after this empty section. Also note that although the initial value C0 is explained as a constant value here, it is also allowable that, for example, the flash memory 54 stores a table in which a temperature U and the initial value C0 are associated with each other, and that the value of the initial value C0 is determined based on this table and the temperature U indicated by the temperature information obtained by the temperature sensor 59.

Then, the controller 50 resets the timer 61 to thereby start the measurement of the duration time Ttc of the capping state of the cap 21 (hereinafter referred also to as a "capping duration time Ttc" in some cases) (S102), and resets the value of a variable N to "1 (one)" (S103).

Next, under a condition that the state of the cap 21 is not switched to the uncapping state (S104: NO), the controller 50 determines whether or not the capping duration time Ttc does not exceed a time which is N times a predetermined time Tt1 [N×Tt1] (S105). In a case that the capping duration time Ttc is not more than the time [N×Tt1] (S105: NO), the processing returns to S104. On the other hand, in a case that the capping duration time Ttc exceeds the time [N×Tt1] (S105: YES), the controller 50 updates the count value C stored in the RAM 53 to a value which is smaller than the current value by ΔC1 [C−ΔC1] (S106), increments the value of the variable N by 1 (one) (S107), and returns the processing to S104. With this, in a case that the capping state is continued, the count value C is made to be smaller by ΔC1 every time the capping duration time Ttc elapses by the time Tt1.

Under a condition that the state of the cap 21 is switched to the uncapping state (S104: YES), the controller 50 resets the timer 61 to thereby start the measurement of the duration time Ttu of the uncapping state of the cap 21 (hereinafter referred also to as an "uncapping duration time Ttu" in some cases) (S108), and resets the value of the variable N to 1 (one) (S109).

Next, under a condition that the state of the cap 21 is not switched to the capping state (S110: NO), the controller 50 determines whether or not the uncapping duration time Ttu does not exceed a time which is N times a predetermined time Tt2 [N×Tt2] (S111). In a case that the uncapping duration time Ttu is not more than the time [N×Tt2] (S111: NO), the processing returns to S110. On the other hand, in a case that the uncapping duration time Ttu exceeds the time [N×Tt2] (S111: YES), the controller 50 updates the count value C stored in the RAM 53 to a value which is greater than the current value by ΔC2 [C+ΔC2] (S112), increments the value of the variable N by 1 (one) (S113), and returns the processing to S110. With this, in a case that the uncapping state is continued, the count value C is made to be greater by ΔC2 every time the uncapping duration time Ttu elapses by the time Tt2. Here, the time Tt2 may be same as the time Tt1, or may be different from the time Tt1. Further, the value ΔC2 may be same as ΔC1, or may be different from ΔC1.

Then, under a condition that the state of the cap 21 is switched to the capping state (S110: YES), the controller 50 causes the RAM 53 to store the count value C at the current time (the current count value C), as a value of the capping-time parameter Dc which indicates the cap evaporation rate at a time of the switching of the state of the cap 21 to the capping state performed last time (S114), and returns the processing to S102.

<Control During Printing>

Next, an explanation will be given about the control performed by the controller 50 under a condition that a print instruction (corresponding to a "jetting instruction" of the present teaching) for causing the printer 1 to perform printing is input. For example, in a case that the printer 1 is in a stand-by state wherein any printing is not being performed, the cap 21 is made to be in the capping state to thereby suppress the increase in evaporation rate of the water content in the ink inside the nozzles 10 which is caused due to the evaporation of the water content in the ink inside the nozzles 10. Further, in a case that the print instruction is input to the printer 1, the controller 50 performs a processing along the flow as depicted in FIG. 4.

Figure 4:
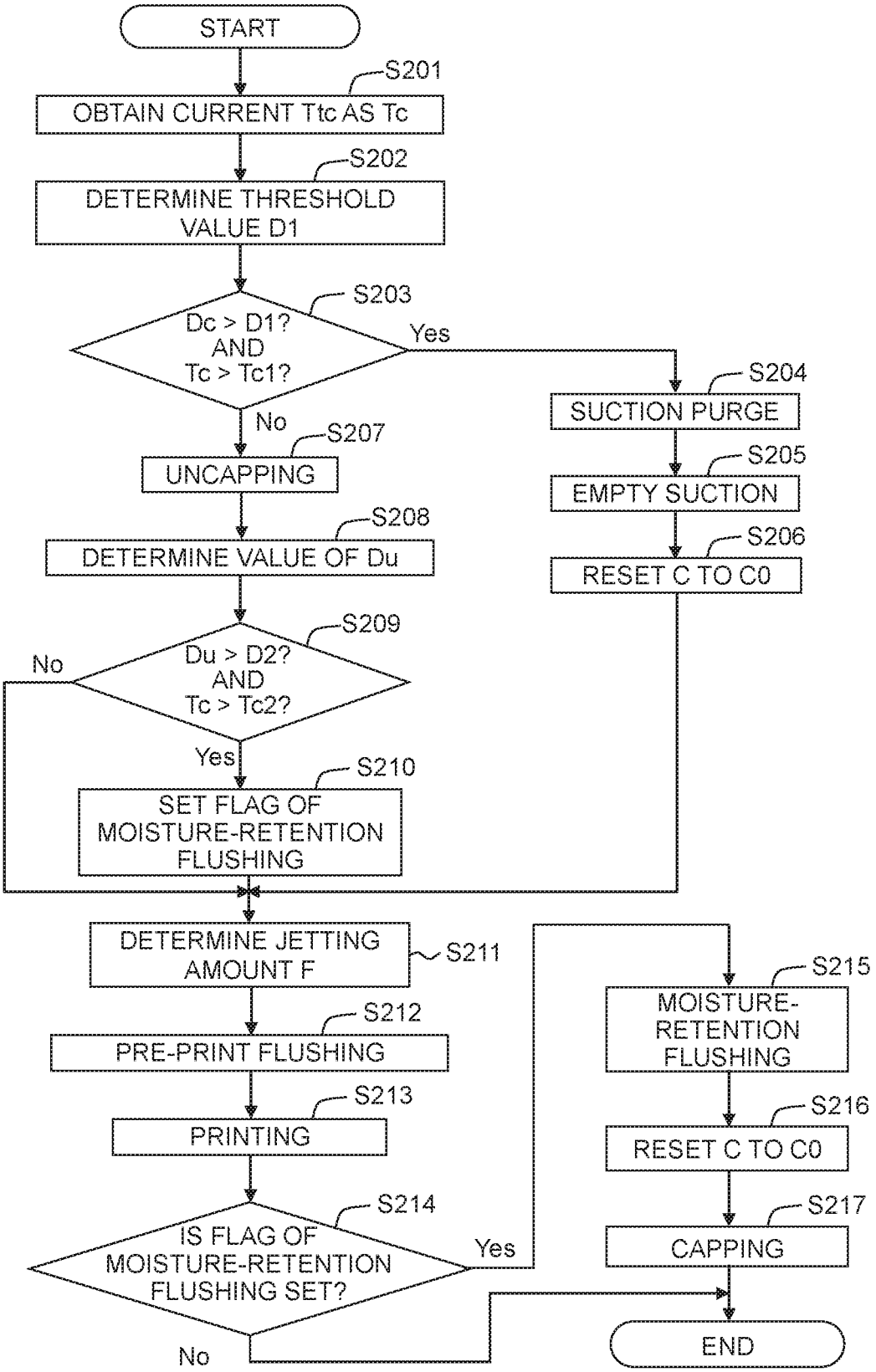
FIG. 4 is a flowchart depicting the flow of a processing in a case that a print instruction is input.

To provide a more specific explanation, as depicted in FIG. 4, in a case that the print instruction is input, the controller 50 obtains the capping duration time Ttc measured by the timer 61 at this time (of the input of the print instruction), as a capping time Tc (S201). With this, the obtained capping time Tc is a duration time of the capping state since the switching of the state of the cap 21 to the capping state performed last time and until (up to) the input of the print instruction. Further, the controller 50 determines a threshold value D1 which is used in determination performed next in S203 (S202). Specifically, the flash memory 54 stores a table in which the temperature U and the threshold value D1 are associated with each other, as depicted in FIG. 5A. Then, in S202, the threshold value D1 is determined selectively as being one of a threshold value D11 and a threshold value D12, depending on whether or not the temperature U indicated by the temperature information obtained by the temperature sensor 59 is not less than a temperature U1 (for example, 10° C.) or less than the temperature U1. Here, the threshold value D12 indicated in the table of FIG. 5A under a condition that the temperature U indicated by the temperature information obtained by the temperature sensor 59 is less than the temperature U1 is made to be smaller than the threshold value D11 indicated in the table of FIG. 5A under a condition that the temperature U indicated by the temperature information obtained by the temperature sensor 59 is not less than the temperature U1.

Next, the controller 50 determines whether or not a purge condition that the capping time Tc exceeds a time Tc1 (corresponding to a "predetermined time", a "first time" of the present teaching; for example, 6 hours) and that the value of the capping-time parameter Dc exceeds the threshold value D1 (corresponding to a "predetermined value", a "first threshold value" of the present teaching) is satisfied (S203).

In a case that the purge condition is satisfied (S203: YES), the controller 50 controls the switching unit 22 and the suction pump 23 to perform the suction purge (S204). Next, the controller 50 controls the cap ascending/descending mechanism 58, the switching unit 22 and the suction pump 23 to thereby perform the empty suction (S205), resets the count value C to the initial value C0 (S206), and proceeds to S211. Here, in the suction purge in S204, the suction purge regarding the black ink and the suction purge regarding the color inks are performed sequentially. Further, when performing the empty suction in S205, the state of the cap 21 is switched to the uncapping state.

On the other hand, in a case that the purge condition is not satisfied (S203: NO), the controller 50 controls the cap ascending/descending mechanism 58 to thereby switch the state of the cap 21 to the uncapping state (S207), and obtains the count value C at this time (of the switching to the uncapping state), as the value of an immediately-before parameter Du (S208). The value of the immediately-before parameter Du indicates the cap evaporation rate immediately before the printing is performed (hereinafter referred also to as an "immediately-before evaporation rate" in some cases).

Next, the controller 50 determines whether or not a flushing condition that the capping time Tc exceeds a predetermined time Tc2 (corresponding to a "second time" of the present teaching, for example, 30 minutes) and that the value of the immediately-before parameter Du exceeds a threshold value D2 (corresponding to a "second threshold value" of the present teaching) is satisfied (S209). Then, in a case that the flushing condition is satisfied (S209: YES), the controller 50 sets a flag of a moisture-retention flushing (to be described later on) (S210), and proceeds to S211. On the other hand, in a case that the flushing condition is not satisfied (S209: NO), the controller 50 does not set the flag, and proceeds to S211.

In S211, the controller 50 determines a jetting amount F by which the ink is jetted from the nozzles 10 in a pre-print flushing to be performed next. For example, the flash memory 54 stores a table in which the capping time Tc and the value of the capping-time parameter Dc are associated with the jetting amount F in the pre-print flushing, as depicted in FIG. 5B. In S212, the jetting amount F of the ink in the pre-print flushing is determined based on the capping time Tc and the capping-time parameter Dc and based on this table. Here, jetting amounts F1 to F6 in FIG. 5B have a magnitude relationship of: F1<F2<F3<F4<F5<F6. Here, the reason that the jetting amount F under a condition that the capping time Tc exceeds the time Tc1 and that the value of the capping-time parameter Dc is greater than the threshold value Dc1 is made to be the jetting amount F1 which is smaller than the jetting amounts F2 to F6 is that because in this case, the purge condition is satisfied, the suction purge has been performed immediately therebefore, and that the viscosity of the ink inside the nozzles 10 becomes to be small. Note that in the case that the capping time Tc exceeds the time Tc1 and that the value of the capping-time parameter Dc is greater than the threshold value Dc1, it is allowable that the jetting amount F is made to be further smaller than the jetting amount F1, or even that the jetting amount F is made to be 0 (zero) and the pre-print flushing is not performed. Further, in the table depicted in FIG. 5B, the jetting amount F in a case that the capping time Tc is not more than the time Tc0 (Tc0<Tc1) and that the value of the capping-time parameter Dc is not more than the threshold value Dc0 (Dc0<Dc1) is set to be the jetting amount F1 which is smaller than the jetting amounts F2 to F6. However, the present teaching is not limited to or restricted by such a case; it is allowable to provide such a configuration that the jetting amount F in a case that the capping time Tc is not more than the time Tc0 (Tc0<Tc1) and that the value of the capping-time parameter Dc is not more than the threshold value Dc0 (Dc0<Dc1) is set to be 0 (zero) so as not to perform the pre-print flushing.

Next, the controller 50 controls the carriage motor 56 so as to move the carriage 2 to the flushing position, then controls the actuator 14 to thereby perform the pre-print flushing (corresponding to a "pre-jetting flushing" of the present teaching) for causing the ink(s) to be jetted from the nozzles 10 toward the flushing foam 7 (S212). In the pre-print flushing, the controller 50 causes the ink(s) to be jetted in the jetting amount F determined in S211. For example, as the jetting amount F determined in S211 is greater, the jetting count (jetting number of times) of the inks to be jetted from the nozzles 10 is made to be greater.

Next, the controller 50 performs printing on the recording paper P (corresponding to a "jetting operation" of the present teaching) (S213). Specifically, the controller 50 controls the conveyance motor 57 so as to cause the conveyance rollers 5 and 6 to convey the recording paper P by a predetermined distance, and the controller 50 controls the actuator 14 so as to jet the ink(s) from the nozzles 10 toward the recording paper P every time the recording paper P is conveyed by the predetermined distance, while controlling the carriage motor 56 to move the carriage 2 in the scanning direction, thereby performing the recording on the recording paper P.

In a case that the flag of the moisture-retention flushing is set after the completion of the printing (S214: YES), the controller 50 controls the carriage motor 56 so as to move the carriage 2 up to the maintenance position. In this state, the controller 50 controls the actuator 14 so as to perform the moisture-retention flushing for causing the ink(s) to be jetted from the nozzles 10 toward the cap 21 (S215). In a case that the moisture-retention flushing is performed, the cap evaporation rate is lowered by the water content of the ink discharged from the nozzles 10. Here, the amount of the ink(s) discharged from the ink-jet head 3 by the moisture-retention flushing is smaller than the amount of the ink(s) discharged from the ink-jet head 3 by the suction purge performed before the printing in S204. Further, after the moisture-retention flushing, the controller 50 resets the count value C to the initial value C0 (S216), and then the controller 50 controls the cap ascending/descending mechanism 58 to as to switch the state of the cap 21 to the capping state (S217). On the other hand, in a case that the flag of the moisture-retention flushing is not set (S214: NO), the controller controls the cap ascending/descending mechanism 58 so as to switch the state of the cap 21 to the capping state (S217), without performing the moisture-retention flushing and the resetting of the count value C.

<Control Performed During Suction Purge Performed by Instruction from User>

Further, the printer 1 is configured such that the user operates the operation part 62 to thereby make it possible to input a purge instruction for instructing performance of the suction purge. In a case that the purge instruction is input, the controller 50 performs the processing along a flow depicted in FIG. 6.

Figure 6:
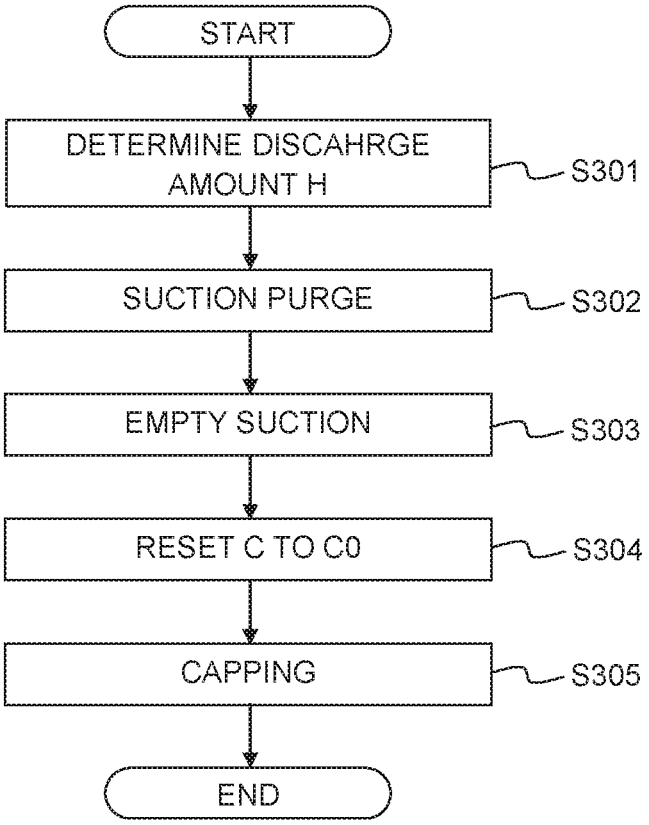
FIG. 6 is a flowchart depicting the flow of a processing in a case that a purge instruction is input by a user.

Regarding this processing, a more specific explanation will be provided as follows: as depicted in FIG. 6, under a condition that the purge instruction is input, the controller 50 determines a discharge amount H of the ink in the suction purge (S301). For example, a table in which the capping duration time Ttc and the value of the capping-time parameter Dc (each of which being) since the switching of the state of the cap 21 to the capping state performed last time and until the input of the purge instruction are associated with the discharge amount H in the suction purge performed by the instruction from the user. In S301, the discharge amount H of the ink(s) in the suction purge is determined based on the capping duration time Ttc and the capping-time parameter Dc and based on the table of FIG. 7. Here, discharge amounts H1 to H6 in FIG. 7 have a magnitude relationship of: H1<H2<H3<H4<H5<H6. Next, the controller 50 controls the switching unit 22 and the suction pump 23 so as to perform the suction purge (S302). In the suction purge of S302, the controller 50 causes the ink(s) to be discharged in the discharge amount H determined in S301. Specifically, as the discharge amount H is greater, the rotation time of the suction pump 23 is made to be longer. Then, after the suction purge, the controller 50 controls the cap ascending/descending mechanism 58, the switching unit 22 and the suction pump 23 to thereby perform the empty suction (S303). Afterwards, the controller 50 resets the count value C to the initial value C0 (S304), controls the cap ascending/descending mechanism 58, and switches the state of the cap 21 to the capping state (S305).

In the embodiment explained above, in a case that the capping-time evaporation rate is high (the value of the capping-time parameter Dc is great), and that the capping time Tc is long, the viscosity of the ink in the nozzles 10 is easily increased, due to the movement of the water content from the ink inside the nozzles 10 to the ink inside the cap 21. On the other hand, in a case that the capping-time evaporation rate is low (the value of the capping-time parameter Dc is small) and/or that the capping time Tc is short, the increase in viscosity of the ink inside the nozzles 10 due to the above-described movement of the water content is less likely to occur.

In view of the above-described situation, in the present embodiment, under a condition that the purge condition that the capping time Tc exceeds the time Tc1 and that the value of the capping-time parameter Dc exceeds the threshold value D1 is satisfied in a case that the print instruction is input, the printing is performed after the suction purge has been performed. By doing so, in a case that the viscosity of the ink inside the nozzles 10 is high, it is possible to perform the suction purge so as to discharge a highly viscous ink inside the nozzles 10, and then to perform the jetting operation (printing). On the other hand, under a condition that the purge condition is not satisfied, and in a case that the viscosity of the ink liquid inside the nozzles 10 is not increased much, it is possible to prevent the ink from being discharged unnecessarily from the ink-jet head 3, by performing the jetting operation (printing) without performing the suction purge.

Further, in a case that as the capping time Tc is longer and that the capping-time evaporation rate is higher, the viscosity of the ink in the nozzles 10 is easily increased, due to the movement of the water content from the ink inside the nozzles 10 into the ink inside the cap 21. Accordingly, it is appropriate to make the purge condition to be such a condition that the capping time Tc exceeds the time Tc1 and that the value of the capping-time parameter Dc exceeds the threshold value D1.

Furthermore, under a condition that the temperature is lower than a predetermined temperature (for example, lower than 10° C.), the viscosity of the ink becomes particularly high, and the liquid (ink) is less likely to be easily jetted from the nozzles 10. In view of this situation, in the present embodiment, in a case that the temperature information obtained by the temperature sensor 59 indicates a temperature which is less than the temperature U1, the threshold value D1 is made to be smaller than that in another case wherein the temperature information indicates a temperature which is not less than the temperature U1. With this, under a condition that the temperature is low, the frequency at which the suction purge is performed before the printing becomes high, thereby making it possible to prevent the increase in viscosity of the ink inside the nozzles 10. On the other hand, under a condition that the temperature is high, the frequency at which the suction purge is performed before the printing becomes low, thereby making it possible to prevent the suction purge from being performed unnecessarily, and consequently to prevent any wasteful discharge of the ink.

Under a condition that the immediately-before evaporation rate is high (the value of the immediately-before parameter Du is great) in a case that the suction purge is not performed before the jetting operation (printing), then, when the state of the cap 21 is switched to the capping state after the completion of the printing, the movement of water content as described above occurs as the time lapses, which in turn increase the viscosity of the ink inside the nozzles 10. In view of this, in a case that the purge condition is not satisfied, the present embodiment determines whether or not the flushing condition that the capping time Tc exceeds the time Tc2 and that the value of the immediately-before parameter Du exceeds the threshold value D2. Further, in a case that the flushing condition is satisfied, the moisture-retention flushing is performed after the printing. With this, in a case that the cap evaporation rate is lowered, and that the state of the cap 21 is switched to the capping state after the completion of printing, it is possible to suppress the increase in viscosity of the ink inside the nozzles 10 due to the movement of water content as described above which occurs as the time lapses. Furthermore, in a case that the moisture-retention flushing is performed so as to lower the cap evaporation rate, it is possible to make the amount of the ink discharged from the ink-jet head 3 to be smaller than that in a case of performing the suction purge for lowering the cap evaporation rate.

Note that the reason for performing the moisture-retention flushing after the printing, rather than before the printing, is as follows. Namely, in a case that the moisture-retention flushing is performed before the printing, the state of the cap 21 is switched to the uncapping state during the printing, and the water content is evaporated from the ink inside the cap 21 in this situation. Accordingly, if the moisture-retention flushing is performed before the printing, a part or portion of the water content supplied by the moisture-retention flushing is wasted uselessly.

Note that, however, even in a case that the immediately-before evaporation rate is high, under a condition that the frequency at which the printing is performed is high, then the capping time Tc is short and that the above-described movement of the water-condition is less likely to occur. Further, in this case, the uncapping duration time Ttu is long, and the water content in the ink inside the cap 21 is likely to evaporate to the outside of the cap 21. Accordingly, if the moisture-retention flushing is performed in a case that the frequency at which the printing is performed is high, then the evaporation amount of the water content in the ink inside the cap 21 evaporated to the outside of the cap 21 becomes great, and thus a part or portion of the water content, supplied by the moisture-retention flushing, will be uselessly wasted. Furthermore, in the case that the frequency of the printing is high, the frequency at which the ink is jetted from the nozzles 10 toward the recording paper P is also high, and thus the viscosity of the ink inside the nozzles 10 does not become high.

In view of these situations, the present embodiment makes the flushing condition to be a such a condition that the capping time Tc exceeds the time Tc2 and that the value of the immediately-before parameter Du exceeds the threshold value D2, rather than making the flushing condition only regarding the immediately-before parameter Du. By doing so, in a case that the immediately-before evaporation rate is high and that the frequency at which the printing is performed is low (the capping time Tc is long), the moisture-retention flushing is performed to thereby lower the cap evaporation rate and to suppress the increase in viscosity of the liquid (ink) inside the nozzles 10. On the other hand, in a case that the immediately-before evaporation rate is low and/or that the frequency at which the printing is performed is high, it is possible to suppress the wasteful discharge of the ink from the ink-jet head 3, by not performing the moisture-retention flushing.

Further, by setting the purge condition and the flushing condition as in the present embodiment, in a case that the printing is performed at a frequency of certain extent (at a time interval that is longer than the time Tc2 and not more than the Tc1), the moisture-retention flushing is also performed at a certain frequency. Accordingly, in such a case, the viscosity of the ink inside the nozzles 10 does not become high, and there is no need to perform the suction purge before the printing. Namely, in a case that the printing is performed at the frequency of certain extent, the moisture-retention flushing suppresses the increase in viscosity of the ink inside the nozzles 10.

On the other hand, in a case that the printing is not performed for a long period of time (for a time longer than the Tc1), the moisture-retention flushing is not also performed for a long period of time. Further, in a case that the printing and the moisture-retention flushing are not performed for a long period of time, there is such a fear that the viscosity of the ink inside the nozzles 10 might become high. In such a case, when the print instruction is input afterwards, there is such a fear that the viscosity of the ink inside the nozzles 10 might be high at a time at which the printing is performed, even if the moisture-retention flushing is to be performed after the printing, and that the ink might not be jetted normally from the nozzles 10. In view of this situation, in such a case, the printing is performed after the suction purge is performed, thereby making it possible to cause the ink to be jetted normally from the nozzles 10 when the printing is performed. Namely, in such a case that only the moisture-retention flushing is performed, and that the viscosity of the ink inside the nozzles 10 after the moisture-retention flushing would be high (would remain to be high), the suction purge is performed before the printing so as to discharge the ink inside the nozzles 10 of which viscosity has becomes to be high. Further, in the present embodiment, only in a case that the purge condition is not satisfied (S203: NO), it is determined whether or not the flushing condition is satisfied (S209). Therefore, in a case that the purge condition is satisfied and that the suction purge is performed before the printing, the moisture-retention flushing is not performed after the printing. Namely, the suction purge before the printing and that the moisture-retention purge after the printing are not performed in an overlapped manner.

Moreover, since the moisture-retention flushing is performed after the printing, it is conceivable that the determination, as to whether or not the flushing condition is satisfied, is performed after the printing. However, in the present embodiment, the flushing condition includes the condition regarding the value of the immediately-before parameter Du. Therefore, in such a case that the determination as to whether the flushing condition is satisfied is performed after the printing, it is necessary that the value of the immediately-before parameter Du is obtained at a time before the printing and is made to be stored in the RAM 53 until after the printing, which in turn results in the increase in the memory capacity.

In view of the above-described situation, the present embodiment determines whether or not the flushing condition is satisfied, before performing the printing. By doing so, there is no need to cause the RAM 53 to store the value of the immediately-before parameter Du obtained before the printing, until after the printing, thereby making it possible to suppress the increase in the memory capacity.

Further, in a case that the cap 21 is in the capping state, the water content moves from the ink inside the nozzles 10 to the ink inside the cap 21, thereby lowering the cap evaporation rate. On the other hand, in a case that the cap 21 is in the uncapping state, the water content in the ink inside the cap 21 evaporates to the outside of the cap 21, thereby increasing the cap evaporation rate. Accordingly, as described above, it is possible to make the count value C to correspond correctly to the cap evaporation rate by performing calculation such that in a case that the cap 21 is in the capping state, the count value C is made to be smaller by ΔC1 every time the capping duration time Ttc elapses by the time Tt1 and that in a case that the cap 21 is in uncapping state, the count value C is made to be greater by ΔC2 every time the uncapping duration time Ttu elapses by the time Tt2.

Then, the count value C at the time of the switching of the state of the cap 21 to the capping state performed last time is used as the value of the capping-time parameter Dc. With this, the value of the capping-time parameter Dc can be made to be close to an actual cap evaporation rate at the time of the switching of the state of the cap 21 to the capping state performed last time. Further, the count value C at the time of the switching of the state of the cap 21 to the uncapping state performed last time is used as the value of the immediately-before parameter Du. With this, the value of the immediately-before parameter Du can be made to be close to an actual cap evaporation rate at the time immediately before the printing.

Furthermore, in a case that the print instruction is input, even if the purge condition is not satisfied, the viscosity of the ink inside the nozzles 10 is increased to some extent due to the above-described movement of the water content in the capping state. Moreover, the extent of the increase in the viscosity of the ink inside the nozzles 10 changes depending on the capping-time evaporation rate and the capping time Tc. In view of this, under a condition that the purge condition is not satisfied in a case that the print instruction is input, the present teaching performs the printing after performing the pre-print flushing. Further, in the pre-print flushing, the ink is discharged in the jetting amount F corresponding to the capping time Tc and the value of the capping-time parameter Dc. With this, it is possible to discharge the ink of which viscosity is increased in the nozzles 10, while preventing the ink from being discharged unnecessarily due to the pre-print flushing. Note that in the present embodiment, even in a case that the purge condition is satisfied and that the suction purge is performed before the printing, then the pre-print flushing is performed immediately before the printing, thereby discharging the ink of which viscosity is increased in the nozzles 10 after the suction purge and until the start of printing.

Further, in the suction purge performed by the instruction from the user, it is possible to discharge the ink in a discharge amount based on (corresponding to) the degree or extent by which the viscosity of the ink is increased inside the ink-jet head 3, from the viewpoint of not allowing the ink to be discharged unnecessarily due to the suction purge. On the other hand, the suction purge performed by the instruction from the user is input in a case that the cap 21 is in the capping state, and the degree or extent by which the viscosity of the ink is increased inside the liquid jetting head (ink-jet head 3) at the time of the input of the purge instruction from the user changes depending on the capping duration time Ttc of the capping state and the capping-time evaporation rate (each of which being) since the switching of the state of the cap 21 to the capping state performed last time and until the input of the purge instruction. In view of this situation, in a case that the purge instruction is input by the user, the present embodiment performs the suction purge such that the ink is discharged in a discharge amount corresponding to the capping duration time Ttc and the value of the capping-time parameter Dc (each of which being) since the switching of the state of the cap 21 to the capping state performed last time and until the input of the purge instruction.

Although the embodiment of the present teaching has been explained above, the present teaching is not limited to or restricted by the above-described embodiment; various kinds of change may be made to the above-described embodiment without departing from the gist and/or scope of the present teaching.

In the present embodiment, although the determination as to whether or not the flushing condition is satisfied is performed before the printing, there is no limitation to this. Since the moisture-retention flushing is performed after the printing, it is allowable to perform the determination, as to whether or not the flushing condition is satisfied, after the printing. Note that, however, in this case, it is necessary that the value of the immediately-before parameter Du is obtained before the printing, and that the obtained value of the immediately-before parameter Du is stored by the RAM 53 until after the printing.

Further, in the above-described embodiment, regarding the value of the immediately-before parameter Du which becomes greater as the immediately-before evaporation rate is higher, the flushing condition is made to be such a condition that the value of the immediately-before parameter Du exceeds the threshold value D2 and that the capping time Tc exceeds the time Tc2. However, there is no limitation to this. For example, in a case that the immediately-before parameter Du is such a parameter that the value of the immediately-before parameter Du becomes smaller as the immediately-before evaluation rate is higher, it is allowable that the flushing condition is made to be such a condition that the value of the immediately-before parameter Du is not more than a predetermined threshold value and that the capping time Tc exceeds the time Tc2. Further, the flushing condition may be another condition regarding the value of the immediately-before parameter Du and the capping time Tc.

Furthermore, the flushing condition it not limited to or restricted by being the condition regarding both of the value of the immediately-before parameter Du and the capping time Tc. The flushing condition may be a condition regarding only the immediately-before parameter Du. Note that, however, in such a case, the moisture-retention flushing is performed even when the printing is performed frequently, and there is such a fear that a part or portion of the water content supplied to the ink inside the cap 21 by the moisture-retention flushing might be wasted uselessly.

Moreover, in the above-described embodiment, in a case that the purge condition is not satisfied, it is determined whether or not the flushing condition is satisfied; and in a case that the flushing condition is satisfied, the moisture-retention flushing is performed after the printing. However, there is no limitation to this. It is allowable that, in a case that the purge condition is not satisfied, the moisture-retention flushing is not performed after the printing.

In the embodiment described above, in a case that the purge condition is not satisfied, the printing is performed after the pre-print flushing has been performed. On the other hand, in a case that the purge condition is satisfied, the printing is performed after the suction purge has been performed. In other words, in the embodiment, depending on the capping time Tc and (the value of) the capping-time parameter Dc, any one of the following processings is selected, namely: (i) not to perform the pre-print flushing, (ii) to perform the pre-print flushing (jetting amount: small), (iii) to perform the pre-print flushing (jetting amount: large), (iv) to perform the pre-print purge.

The present teaching is not limited to or restricted by the above-described aspect. For example, it is allowable to select, depending on the capping time Tc and (the value of) the capping-time parameter Dc, any one of the following processings, namely: (i) not to perform the pre-print flushing, (ii) to perform the pre-print flushing (jetting amount: small), and (iii) to perform the pre-print flushing (jetting amount: large). In such a case, even if the purge condition is satisfied, it is allowable that the purge processing is not performed, and thus is applicable, for example, also to an ink-jet printer which is not provided with the function for performing the purge processing. For example, as depicted in FIG. 8, it is possible to set the jetting amount F, in the pre-print flushing in a case that the capping time Tc exceeds the time Tc1 and that the value of the capping-time parameter Dc exceeds the threshold value Dc, to a jetting amount F7 which is greater than the jetting amount F6. In this case, the suction purge is not performed even if the capping time Tc becomes long to exceed the time Tc1 and that the capping-time parameter Dc becomes great to exceed the predetermined threshold value (Dc1). However, since the jetting amount F in the pre-print flushing in such a case is set to be the jetting amount F7 which is greater than the jetting amounts F1 to F6, it is possible to discharge the ink in a discharge amount corresponding to the extent of the increase in viscosity of the ink inside the ink-jet head 3, while suppressing the discharge amount of the ink as compared with the case of performing the suction purge.

Note that in the table depicted in FIG. 8, the jetting amount F, in the pre-print flushing in a case that the capping time Tc is not more than the time Tc0 (Tc0<Tc1) and that the value of the capping-time parameter Dc is not more than the threshold value Dc0 (Dc0<Dc1), is set to the jetting amount F1 which is smaller than the discharge amounts F2 to F7. However, the present teaching is not limited to or restricted by such a case. For example, it is allowable that the jetting amount F, in the case that the capping time Tc is not more than the time Tc0 (Tc0<Tc1) and that the value of the capping-time parameter Dc is not more than the threshold value Dc0 (Dc0<Dc1), is made to be 0 (zero) and the pre-print flushing is not performed.

Alternatively, it is allowable to select, depending on the capping time Tc and (the value of) the capping-time parameter Dc, any one of the following processings, namely: (i) not to perform the pre-print flushing, (ii) to perform the pre-print flushing (jetting amount: small), (iii) to perform the pre-print flushing (discharge amount: large), (iv) to perform the pre-print purge, and (v) to perform both of the pre-print flushing and the pre-print purge.

For example, in a case that the purge condition is satisfied, and further that the capping-time time Tc exceeds the time Tc2 (Tc2>Tc1) or that the value of the capping-time parameter Dc exceeds the threshold value Dc2 (Dc2>Dc1), it is possible to make the jetting amount F in the pre-print flushing to be the jetting amount F1; in a case that although the purge condition is satisfied, and that the capping-time time Tc is not more than the time Tc2 (Tc2>Tc1) and that the value of the capping-time parameter Dc is not more than the threshold value Dc2 (Dc2>Dc1), it is possible to make the jetting amount F in the pre-print flushing to be 0 (zero). Further, in this case, under a condition that the capping time Tc is not more than the time Tc0 (Tc0<Tc1) and that the value of the capping-time parameter Dc is not more than the threshold value Dc0 (Dc0<Dc1), it is also allowable that the jetting amount F is made to be 0 (zero) and that the pre-print flushing is not performed.

Alternatively, it is allowable to select, depending on the capping time Tc and (the value of) the capping-time parameter Dc, any one of the following processings, namely: (i) not to perform the pre-print purge, (ii) to perform the pre-print purge (jetting amount: small), and (iii) to perform the pre-print purge (jetting amount: large).

Furthermore, in the above-described embodiment, the threshold value D1, under a condition that the temperature U indicated by the temperature information obtained by the temperature sensor 59 is less than the temperature U1, is made to be smaller than the threshold value D1 under a condition that the temperature U indicated by the temperature information obtained by the temperature sensor 59 is not less than the temperature U1. However, there is no limitation to this. It is allowable, for example, that the time Tc1, under a condition that the temperature U indicated by the temperature information obtained by the temperature sensor 59 is less than the temperature U1, may be made to be shorter than the time Tc1 under a condition that the temperature U indicated by the temperature information obtained by the temperature sensor 59 is not less than the temperature U1. Alternatively, it is also allowable that one of the threshold value D1 and the time Tc1 is constant regardless of the temperature. In such a case, the temperature sensor 59 may be omitted.

Further, in the above-described embodiment, regarding the value of the capping-time parameter Dc which becomes greater as the capping-time evaporation rate is higher, the purge condition is made to be such a condition that the value of the capping-time parameter Dc exceeds the threshold value D1 and that the capping time Tc exceeds the predetermined time Tc1. However, there is no limitation to this. For example, in a case that the capping-time parameter Dc is such a parameter that the value of the capping-time parameter Dc becomes smaller as the capping-time evaporation rate is higher, it is allowable that the flushing condition is made to be such a condition that the value of the capping-time parameter Dc is not more than a predetermined threshold value and that the capping time Tc exceeds the time Tc1. Furthermore, the purge condition may be another condition regarding the value of the capping-time parameter Dc and the capping time Tc. For example, it is allowable that an evaporation rate X of the water content in the ink inside the nozzles 10 (hereinafter also referred to as a "nozzle evaporation rate X" in some cases) is stored in the flash memory 54 as a function of the capping-time parameter Dc and the capping time Tc; it is allowable that the purge condition is such a condition that the nozzle evaporation rate X calculated based on the function exceeds a threshold value. An example of the function may be exemplified as a function represented by an expression indicated below. However, there is no limitation to this. Note that "a" in the following expression is a constant.

$$X = Dc\left\{1 - e^{-\frac{1}{a}Tc}\right\} \quad \text{[Expression 1]}$$

Moreover, in the above-described embodiment, the count value C is calculated such that the count value C is made to be smaller by ΔC1 every time the capping duration time Ttc elapses by the time Tt1, and that the count value C is made to be greater by ΔC2 every time the uncapping duration time Ttu elapses by the time Tt2. However, there is no limitation to this.

Figure 9:
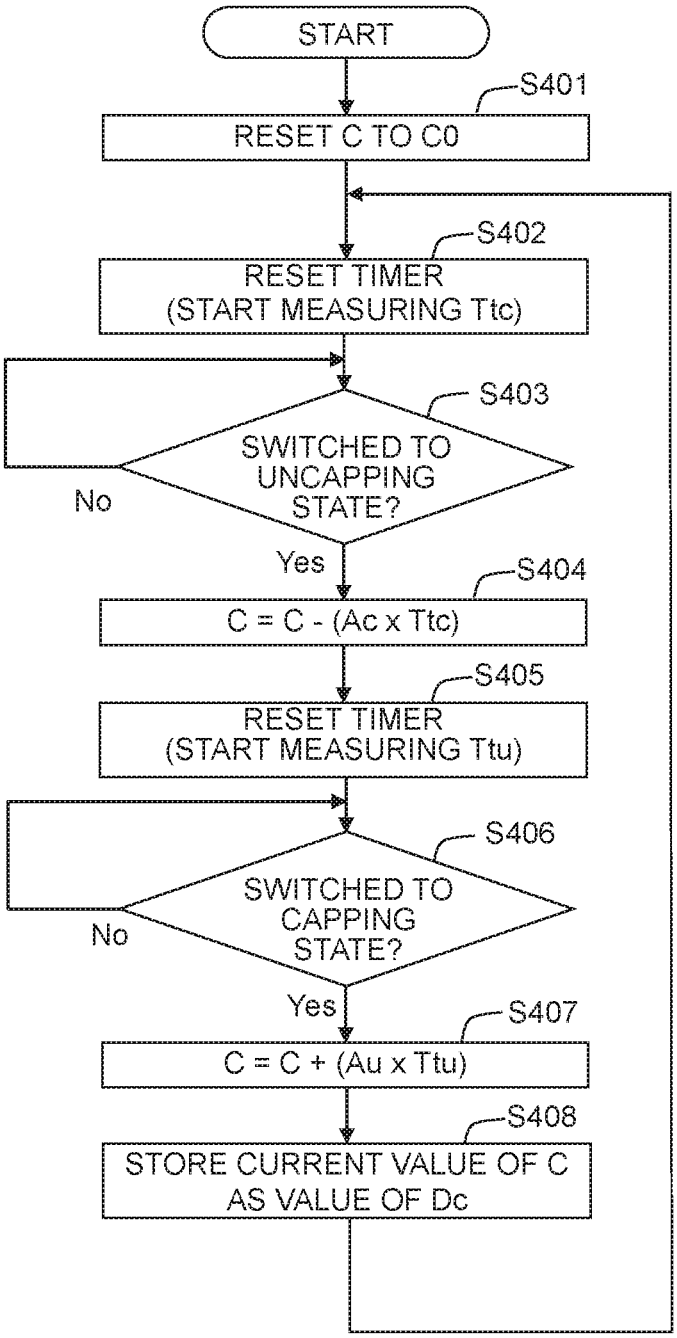
FIG. 9 is a flowchart depicting the flow of a processing for calculating the count value in a first modification.

For example, in a first modification, the controller 50 resets the count value C to an initial value C0 (S401), and resets the timer 61 and starts measuring the capping duration time Ttc (S402), as depicted in FIG. 9. Next, the controller 50 stands by until the state of the cap 21 is switched to the uncapping state (S403: NO), and in a case that the state of the cap 21 is switched to the uncapping state (S403: YES), the controller 50 updates the count value C stored in the RAM 53 to a value [C−(Ac×Ttc)] which is smaller than the stored count value C by a value obtained by multiplying the capping duration time Ttc by a predetermined coefficient Ac [Ac×Ttc] (S404). Here, the coefficient Ac may be a constant value, or may differ depending, for example, the temperature U, etc. Further, the controller 50 resets the timer 61 and starts measuring the uncapping duration time Ttu (S405).

Next, the controller 50 stands by until the state of the cap 21 is switched to the capping state (S406: NO), and in a case that the state of the cap 21 is switched to the capping state (S406: YES), the controller 50 updates the count value C stored in the RAM 53 to a value [C+(Au×Ttu)] which is greater than the stored count value C by a value obtained by multiplying the uncapping duration time Ttu by a predetermined coefficient Au [Au×Ttu] (S407) as a current count value C, causes the RAM 53 to store the current count value C as the value of the capping-time parameter Dc (S408), and returns to S402. Here, the coefficient Au may be a constant value, or may differ depending, for example, the temperature U, etc.

Also in the first modification, the count value C becomes greater as the uncapping duration time Ttu is longer, and becomes smaller as the capping duration time Ttc is longer. Accordingly, the count value C is a value corresponding correctly to the cap evaporation rate.

Further, in the above-described embodiment, the count value C at the time of switching the state of the cap 21 to the capping state, and the count value C at the time immediately before the printing are stored, respectively as the value of the capping-time parameter Dc and the value of the immediately-before parameter Du, by the RAM 53. However, there is no limitation to this. For example, other values each corresponding to the count value C, such as other values each of which is calculated based on the count value C of one of these points of time (the point of time of the switching of the state of the cap 21 to the capping state and the point of time immediately before the printing), may be stored by the RAM 53 as the value of the capping-time parameter Dc and the value of the immediately-before parameter Du.

Furthermore, the present embodiment is not limited to or restricted by a processing for calculating the count value C and for determining the value of the capping-time parameter Dc and the value of the immediately-before parameter Du corresponding to the calculated count value C. For example, it is allowable to calculate an actual cap evaporation rate, and to determine the value of the capping-time parameter Dc and the value of the immediately-before parameter Du corresponding to the calculated cap evaporation rate.

Moreover, in the above-described embodiment, although the jetting amount F of the ink from the nozzles 10 in the pre-print flushing is made to be different corresponding to the capping time Tc and the value of the capping-time parameter Dc, there is no limitation to this. For example, the jetting amount F may be constant regardless of the value of the capping-time parameter Dc and the capping time Tc.

Further, in the above-described embodiment, the discharge amount H in the suction purge, which is performed in a case that the purge instruction is input by the user, is made to be different corresponding to the capping duration time Ttc and the value of the capping-time parameter Dc. However, there is no limitation to this. For example, the discharge amount H may be constant regardless of the value of the capping-time parameter Dc and the capping duration time Ttc.

Furthermore, in the above-described embodiment, although the ink is jetted toward the flushing foam 7 from the nozzles 10 in the pre-print flushing, there is no limitation to this. It is allowable that the printer 1 is not provided with the flushing foam 7 and that the ink is jetted toward the cap 21 from the nozzles 10 in the pre-print flushing. Moreover, in such a case, since the cap evaporation rate is lowered due to the pre-print flushing and the moisture retention flushing, it is allowable that the jetting amount F of the ink from the nozzles 10 in the moisture-retention flushing is made to be smaller than that in the embodiment.

Moreover, in the above-described embodiment, the capping time Tc is the capping duration time since the switching of the state of the cap 21 to the capping state performed last time and until the input of the print instruction. However, there is no limitation to this.

Figure 10:
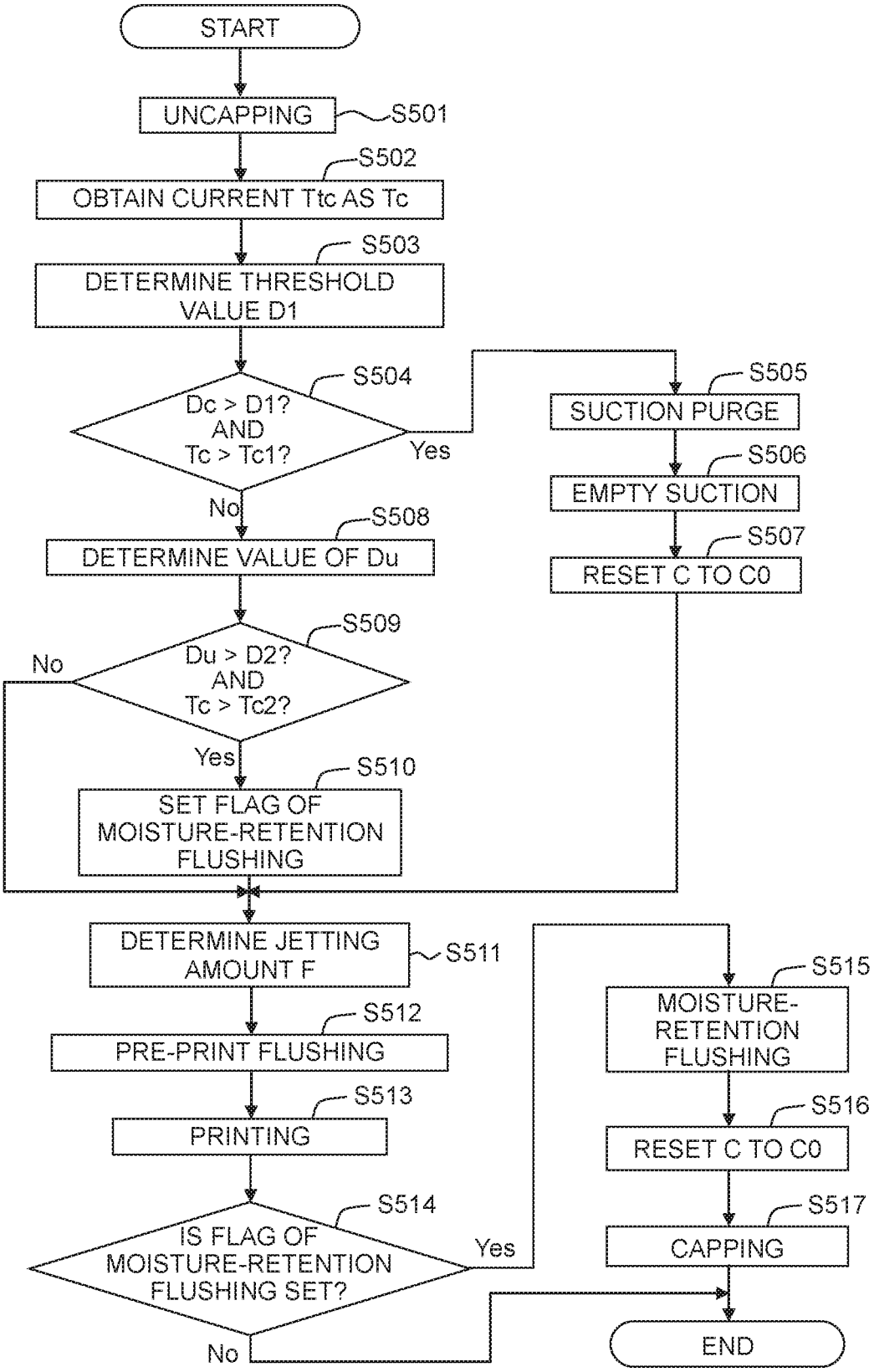
FIG. 10 is a flowchart depicting the flow of a processing in a case that the print instruction is input in a second modification.

For example, in a second modification, in a case that the print instruction is input, the controller 50 firstly controls the cap ascending/descending mechanism 58 so as to switch the state of the cap 21 to the uncapping state (S501), as depicted in FIG. 10. Next, the controller 50 causes the RAM 53 to store, as the capping time Tc, the capping duration time Ttc which is measured by the timer 61 at a time of completion of the switching of the state of the cap 21 to the uncapping state (S502). In this case, the capping time Tc is a duration time of the capping state since the switching of the state of the cap 21 to the capping state performed last time and until the switching of the state of the cap 21 to the uncapping state due to the input of the print instruction.

Next, the controller 50 determines whether or not the purge condition that the capping time Tc exceeds the time Tc1 and that the value of the capping-time parameter Dc exceeds the threshold value D1 is satisfied (S504), in a similar manner as in S203 of the above-described embodiment. In a case that the purge condition is satisfied (S504: YES), the controller 50 performs processing of each of S505 to S507 which are similar respectively to S204 to S206 of the above-described embodiment, then performs processing of each of S511 to S517 which are similar respectively to S211 to S217 of the above-described embodiment. On the other hand, in a case that the purge condition is not satisfied (S504: NO), the controller 50 performs processing of each of S508 to S510 which are similar respectively to S208 to S210 of the above-described embodiment, then performs the processing of each of S511 to S517.

In the second modification, in a case that the purge condition is satisfied after the switching of the state of the cap 21 to the uncapping state, the state of the cap 21 is switched to the capping state for performing the suction purge, and then the state of the cap 21 is consequently switched to the uncapping state for performing the empty suction. This makes the switching count (number of time) for switching the state of the cap 21 between the capping state and the uncapping state becomes great as compared with the case of the above-described embodiment, which in turn causes a time loss. However, the suction purge performed before the printing (pre-print suction purge) is not performed very frequently, and thus even if there were any time loss as described above, the printing time in the printer is not significantly affected by such a time loss.

Further, in the above-described examples, the cap 21 is maintained in the capping state since the switching of the state of the cap 21 to the capping state after the printing performed last time, and until the input of the print instruction. In the above-described embodiment, the capping time Tc is made to be the duration time of the capping state since the switching of the state of the cap 21 to the capping state after the printing performed last time, and until input of the print instruction. In the second modification, the capping time Tc is made to be the duration time of the capping state since the switching of the state of the cap 21 to the capping state after the printing performed last time, and until the switching of the state of the cap 21 to the uncapping state by the input of the print instruction. However, there is no limitation to this.

For example, there is such a situation that since the switching of the state of the cap 21 to the capping state after the printing performed last time and until the input of the print instruction, the state of the cap 21 is temporarily switched to the uncapping state for performing any operation in the printer, in some cases. In such a situation, the capping time Tc may be made to be an accumulated (integrated) time during which the cap 21 is in the capping state since the switching of the state of the cap 21 to the capping state after the printing performed last time and until the input of the print instruction. Alternatively, the capping time Tc may be made to be an accumulated (integrated) time during which the cap 21 is in the capping state since the switching of the state of the cap 21 to the capping state after the printing performed last time, and until the switching of the state of the cap 21 to the uncapping state by the input of the print instruction.

Further, even in a case of switching of the state of the cap 21 temporarily to the uncapping state as described above, provided that for example the time during which the state of the cap 21 is switched to the uncapping state is not very long, it is allowable that the capping time Tc may be a time similar to those in the above-described embodiment and the second modification.

Namely, the capping time may be one of: (i) a time which is included in a time since switching of the state of the cap 21 to the capping state after the printing performed last time and until input of the print instruction, and at least during which the cap 21 is in the capping state; and (ii) a time which is included in a time since the switching of the state of the cap 21 to the capping state after the printing performed last time and until switching of the state of the cap 21 to the uncapping state by input of the print instruction and at least during which the cap is in the capping state.

Further, in the above-described embodiment, although the suction purge is performed to cause the ink inside the ink-jet head 3 to be discharged from the nozzles 10, there is no limitation to this. For example, it is allowable that a pump configured to feed an ink is provided on a channel (flow channel) between the ink cartridges 32 and the ink-jet head 3, such as the tubes 31, and that the pump is driven in a state that the cap 21 is in the capping state to thereby perform a pressure purge for causing the ink(s) inside the ink-jet head 3 to be discharged from the nozzles 10. In such a case, the cap 21 and the above-described pump correspond to the "purge mechanism" of the present teaching. Alternatively, it is also allowable that both the suction purge and the pressure purge are performed to thereby discharge the ink inside the ink-jet head 3 from the nozzles 10. In such a case, the maintenance unit 8 and the pump provided on the tubes 31, etc., collectively correspond to the "purge mechanism" of the present teaching.

Further, although the above-described embodiment is configured such that the state of the cap 21 can be switched between the capping state and the uncapping state by ascending/descending the cap 21 by the cap ascending/descending mechanism 58 in a state that the carriage 2 is located at the maintenance position, there is no limitation to this. For example, it is allowable that a head ascending/descending mechanism configured to ascend/descend the ink-jet head 3 is provided, instead of providing the cap ascending/descending mechanism 58, and that the state of the cap 21 can be switched between the capping state and the uncapping state by ascending/descending the ink-jet head 3 by the head ascending/descending mechanism. Note that in this case, the head ascending/descending mechanism corresponds to the "switching mechanism" of the present teaching. Alternatively, it is also allowable that both the cap ascending/descending mechanism 58 and the head ascending/descending mechanism are provided, and that the state of the cap 21 can be switched between the capping state and the uncapping state by performing both the ascendance/descendance of the cap 21 by the cap ascending/descending mechanism 58 and the ascendance/descendance of the ink-jet head 3 by the head ascending/descending mechanism. Note that in this case, the cap ascending/descending mechanism 58 and the head ascending/descending mechanism collectively correspond to the "switching mechanism" of the present teaching.

Further, in the description above, the explanation has been given about the example in which the present teaching is applied to the printer provided with a so-called serial head configured to jet an ink(s) from a nozzle(s) while moving in the scanning direction. However, the example to which the present teaching is applicable is not limited to this. The present teaching is applicable also to a printer provided with a so-called line head extending over the entire length in the scanning direction of a recording paper (recording paper sheet, recording sheet). Further, the present teaching is not also limited as being applied to a printer configured to jet an ink from a nozzle so as to perform printing. For example, the present teaching is applicable also to a liquid jetting apparatus configured to jet liquid different from the ink(s), such as a material of a wiring pattern for (to be printed on) a wiring board (liquid for a pattern material).

What is claimed is:

1. A liquid jetting apparatus comprising:

a liquid jetting head having a nozzle;

a cap;

a switching mechanism configured to perform switching of a state of the cap between a capping state in which the cap covers the nozzle and an uncapping state in which the cap is apart from the liquid jetting head;

a timer;

a purge mechanism; and a controller configured to perform:

controlling the liquid jetting head to perform a jetting operation for jetting liquid from the nozzle toward a medium;

after controlling the liquid jetting head to perform the jetting operation, controlling the switching mechanism to perform switching of the state of the cap to the capping state;

calculating a value of a capping-time parameter indicative of an evaporation rate of a water content in the liquid inside the cap at a time of the switching of the state of the cap to the capping state performed last time, wherein the capping-time parameter varies according to an uncapped duration time of the uncapping state and a capping duration time of the capping state;

under a condition that a jetting instruction for instructing performance of the jetting operation is input, measuring a capping time with the timer, the capping time being one of:

a time included in a time since the switching of the state of the cap to the capping state after the jetting operation performed last time and until the input of the jetting instruction, and during which the cap is in the capping state; and a time included in a time since the switching of the state of the cap to the capping state after the jetting operation performed last time and until switching of the state of the cap to the uncapping state by the input of the jetting instruction and during which the cap is in the capping state; and under a condition that a purge condition with respect to the capping time and the value of the capping-time parameter is satisfied, controlling the purge mechanism to perform a purge for discharging the liquid in the liquid jetting head from the nozzle to the cap, and then controlling the liquid jetting head to perform the jetting operation.

2. The liquid jetting apparatus according to claim 1, wherein the value of the capping-time parameter becomes greater as the evaporation rate of the water content in the liquid in the cap at the time of the switching of the state of the cap to the capping state performed last time is higher, and the purge condition is a condition that the capping time exceeds a predetermined time and that the value of the capping-time parameter exceeds a predetermined value.

3. The liquid jetting apparatus according to claim 2, further comprising a temperature sensor, wherein in a case that temperature information obtained by the temperature sensor indicates a value being less than a predetermined temperature, the controller is configured to make the predetermined value to be smaller, than the predetermined value in a case that the temperature information indicates a value being not less than the predetermined temperature.

4. The liquid jetting apparatus according to claim 2, further comprising a temperature sensor, wherein in a case that temperature information obtained by the temperature sensor indicates a value being less than a predetermined temperature, the controller is configured to make the predetermined time to be shorter, than the predetermined time in a case that the temperature information indicates a value being not less than the predetermined temperature.

5. The liquid jetting apparatus according to claim 1, wherein under a condition that the purge condition is not satisfied in the case that the jetting instruction is input, the controller is configured to calculate a value of an immediately-before parameter relating to the evaporation rate of the water content in the liquid in the cap at a time that is immediately before the jetting operation is performed, and under a condition that a flushing condition with respect at least to the value of the immediately-before parameter is satisfied, the controller is configured to control the liquid jetting head to perform a post-jetting flushing for jetting the liquid from the nozzle toward the cap, after having controlled the liquid jetting head to perform the jetting operation.

6. The liquid jetting apparatus according to claim 5, wherein the flushing condition is a condition with respect to the capping time and the value of the immediately-before parameter.

7. The liquid jetting apparatus according to claim 6, wherein the value of the capping-time parameter becomes greater as the evaporation rate of the water content in the liquid in the cap at the time of the switching of the state of the cap to the capping state performed last time is higher, the value of the immediately-before parameter becomes greater as the evaporation rate of the water content in the liquid in the cap at the time that is immediately before the jetting operation is performed is higher, the purge condition is a condition that the capping time exceeds a first time, and that the value of the capping-time parameter exceeds a first threshold value, and the flushing condition is a condition that the capping time exceeds a second time shorter than the first time, and that the value of the immediately-before parameter exceeds a second threshold value.

8. The liquid jetting apparatus according to claim 5, wherein the controller is configured to determine whether or not the flushing condition is satisfied before controlling the liquid jetting head to perform the jetting operation, and under a condition that the flushing condition is satisfied, the controller is configured to cause the liquid jetting head to perform the post-jetting flushing after having controlled the liquid jetting head to perform the jetting operation.

9. The liquid jetting apparatus according to claim 1, wherein the controller is configured to perform:

measuring, by the timer, a capping duration time of the capping state since the switching of the state of the cap to the capping state and an uncapping duration time of the uncapping state since the switching of the state of the cap to the uncapping state;

calculating a count value such that the count value is made to be greater as the uncapping duration time of the uncapping state becomes longer and that the count value is made to be smaller as the capping duration time of the capping state becomes longer; and using, as the value of the capping-time parameter, the count value at the time of the switching of the state of the cap to the capping state last time.

10. The liquid jetting apparatus according to claim 1, wherein under a condition that the jetting instruction is input, in a case that the purge condition is not satisfied, the controller is configured to perform:

controlling the liquid jetting head to perform a pre-jetting flushing for jetting the liquid from the nozzle, and then controlling the liquid jetting head to perform the jetting operation; and in the pre-jetting flushing, controlling the liquid jetting head to jet the liquid, from the nozzle, in a jetting amount corresponding to the value of the capping-time parameter and the capping time.

11. The liquid jetting apparatus according to claim 1, further comprising an input unit, wherein under a condition that a purge instruction for instructing performance of the purge is input via the input unit, the controller is configured to control the purge mechanism to perform the purge such that the liquid is discharged in a discharge amount corresponding to the value of the capping-time parameter and a time included in a time since the switching of the state of the cap to the capping state after the jetting operation performed last time and until the input of the purge instruction and during which the cap is in the capping state.

12. The liquid jetting apparatus according to claim 1, wherein the capping-time parameter is increased as the uncapped duration time of the uncapping state becomes greater, and the capping-time parameter is decreased as the capping duration time of the capping state becomes greater.

13. A liquid jetting apparatus comprising:

a liquid jetting head having a nozzle;

a cap;

a switching mechanism configured to perform switching of a state of the cap between a capping state in which the cap covers the nozzle and an uncapping state in which the cap is apart from the liquid jetting head;

a timer;

a purge mechanism; and a controller configured to perform:

controlling the liquid jetting head to perform a jetting operation for jetting liquid from the nozzle toward a medium;

after controlling the liquid jetting head to perform the jetting operation, controlling the switching mechanism to perform switching of the state of the cap to the capping state;

calculating a value of a capping-time parameter relating to an evaporation rate of a water content in the liquid inside the cap at a time of the switching of the state of the cap to the capping state performed last time, wherein the capping-time parameter varies according to an uncapped duration time of the uncapping state and a capping duration time of the capping state;

under a condition that a jetting instruction for instructing performance of the jetting operation is input, measuring a capping time with the timer, the capping time being one of:

a time included in a time since the switching of the state of the cap to the capping state after the jetting operation performed last time and until the input of the jetting instruction, and during which the cap is in the capping state; and a time included in a time since the switching of the state of the cap to the capping state after the jetting operation performed last time and until switching of the state of the cap to the uncapping state by the input of the jetting instruction and during which the cap is in the capping state;

before performing the jetting operation, determining a discharge amount, in which the liquid in the liquid jetting head is to be discharged, based on the capping time and the value of the capping-time parameter; and before the jetting operation, controlling the liquid jetting head to discharge the liquid from the liquid jetting head in the determined discharge amount.

14. The liquid jetting apparatus according to claim 13, wherein the capping-time parameter is increased as the uncapped duration time of the uncapping state becomes greater, and the capping-time parameter is decreased as the capping duration time of the capping state becomes greater.

* * * * *